United States Patent [19]

Hall

[11] 4,096,820

[45] Jun. 27, 1978

[54] HYDRAULICALLY POWERED MARINE PROPULSION TILTING SYSTEM WITH AUTOMATIC LET-DOWN ASSEMBLY

[75] Inventor: Charles B. Hall, Ingleside, Ill.

[73] Assignee: Outboard Marine Corporation, Waukegan, Ill.

[21] Appl. No.: 705,617

[22] Filed: Jul. 15, 1976

Related U.S. Application Data

[63] Continuation of Ser. No. 571,077, Apr. 24, 1975, abandoned.

[51] Int. Cl.[2] ..... B63H 21/26

[52] U.S. Cl. ..... 115/41 HT; 115/17

[58] Field of Search ..... 115/41 HT, 41 R, 17; 114/150; 248/4

[56] References Cited

U.S. PATENT DOCUMENTS

| | | | |
|---|---|---|---|
| 3,508,400 | 4/1970 | Mercier | 114/150 X |
| 3,799,104 | 3/1974 | Kurling | 115/41 HT |
| 3,885,517 | 5/1975 | Borst | 115/41 HT |
| 3,983,835 | 10/1976 | Hall | 115/41 HT |

*Primary Examiner*—Robert B. Reeves
*Assistant Examiner*—Edward M. Wacyra
*Attorney, Agent, or Firm*—Michael, Best & Friedrich

[57] ABSTRACT

A marine propulsion device includes a member adapted to be attached to a boat hull, a propulsion assembly connected to the member for vertical swinging movement, a tilt hydraulic cylinder-piston assembly connected between the member and the propulsion assembly and including a tilt cylinder having opposed first and second ends, a pressure fluid supply pump communicating with a control valve, a first conduit communicating between the first tilt cylinder end and the control valve and including a first valve preventing fluid flow from the control valve and releasably preventing fluid flow from the first tilt cylinder end, a second conduit communicating between the first tilt cylinder end and the control valve and including a second valve preventing flow from the first tilt cylinder end and releasably preventing fluid flow from the control valve, together with a let-down assembly including a third conduit communicating between the ends of the tilt cylinder and including a valve arrangement operative for temporarily affording fluid flow from the first end of the tilt cylinder to the second end thereof in response to the generation of relatively high pressure adjacent the second end thereof occurring incident to the striking of an underwater obstacle.

27 Claims, 2 Drawing Figures

HYDRAULICALLY POWERED MARINE PROPULSION TILTING SYSTEM WITH AUTOMATIC LET-DOWN ASSEMBLY

This application is a continuation of my application Ser. No. 571,077 filed Apr. 24, 1975 and now abandoned.

RELATED APPLICATION

Attention is directed to my co-pending application Ser. No. 571,078, filed Apr. 24, 1975, now U.S. Pat. No. 3,983,835 issued Oct. 5, 1976, which application is incorporated herein by reference.

BACKGROUND OF THE INVENTION

The invention relates generally to marine propulsion devices such as outboard motors and stern drive units.

The invention also relates to arrangements for tilting and trimming the propulsion assemblies of such marine propulsion devices.

The invention further relates to hydraulically operated trimming and tilting arrangements for the propulsion assemblies of such marine propulsion devices.

Attention is directed to the following prior United States Patents:

Carpenter 3,722,455 issued Mar. 27, 1973
Shimanckas 3,847,198 issued Nov. 12, 1974
Borst 3,863,592 issued Feb. 4, 1975
Borst 3,885,517 issued May 27, 1975

SUMMARY OF THE INVENTION

The invention provides a marine propulsion device including a member adapted to be attached to a boat hull, a propulsion assembly pivotally connected to the member for vertical swinging movement when the member is attached to the boat hull, a tilt hydraulic cylinder-piston assembly connected between the member and the propulsion assembly and including a tilt cylinder having opposed first and second ends, a trim hydraulic cylinder-piston assembly including a trim cylinder fixed relative to one of the member and the propulsion assembly, having opposed first and second ends, and having therein a reciprocably movable trim piston having a piston rod extending through the second end of the trim cylinder and adapted for releasable engagement with the other of the member and the propulsion assembly, pressure fluid supply and control means, first conduit means communicating between the first end of the tilt cylinder and the pressure fluid supply and control means and including a first valve preventing fluid flow from the pressure fluid supply and control means to the first end of the tilt cylinder and releasably preventing fluid flow from the first end of the tilt cylinder to the pressure fluid supply and control means, second conduit means communicating between the first end of the tilt cylinder and the pressure fluid supply and control means and including a second valve preventing flow from the first end of the tilt cylinder to the pressure fluid supply and control means and releasably preventing fluid flow from the pressure fluid supply and control means to the first end of the tilt cylinder, and third conduit means communicating between the first end of the trim cylinder and the pressure fluid supply and control means.

In an embodiment in accordance with the invention, the marine propulsion device can also include means communicating between the first and second ends of the tilt cylinder and including means operative for temporarily affording fluid flow from the first end of the tilt cylinder to the second end of the tilt cylinder in response to the generation of relatively high pressure adjacent the second end of the tilt cylinder occurring incident to the striking of an underwater obstacle.

In accordance with an embodiment of the invention, the pressure fluid supply and control means includes a control valve housing having first and second ends, a third valve which is normally closed, which communicates with the first end of the control valve housing and with the first and third conduit means, and which is arranged to releasably prevent fluid flow therethrough to and from the first end of the control valve housing, a fourth valve which is normally closed, which communicates with the second end of the control valve housing and with the second end of the tilt cylinder and with the second end of the trim cylinder and which is arranged to releasably prevent flow therethrough to and from the second end of the control valve housing, and wherein the second conduit means communicates with the first end of the control valve housing.

In accordance with an embodiment of the invention, the marine propulsion device further includes another normally closed valve which communicates between the first end of the tilt cylinder and a sump and which is arranged to afford fluid flow from the second conduit means in the event of a pressure therein above a predetermined level.

The invention also provides a marine propulsion device including a member adapted to be attached to a boat hull, a propulsion assembly connected to the member for vertical swinging movement relative thereto, a hydraulic cylinder-piston assembly connected to the member and to the propulsion assembly and including a tilt cylinder having opposed first and second ends, a piston reciprocable in the tilt cylinder, and a piston rod connected to the piston and extending from the second end of the tilt cylinder, and means communicating between the first and second ends of the tilt cylinder and including means operative for temporarily affording fluid flow from the first end of the tilt cylinder to the second end of the tilt cylinder in response to the generation of relatively high pressure adjacent the second end of the tilt cylinder occurring incident to the striking of an underwater obstacle.

In an embodiment in accordance with the invention, the means for temporarily affording fluid flow from the first end of the tilt cylinder to the second end of the tilt cylinder comprises a first valve communicating between the first end of the tilt cylinder and the second end of the titl cylinder, which first valve is biased to releasably prevent fluid flow therethrough from the first end of the tilt cylinder, a second valve communicating with the second end of the tilt cylinder and biased to releasably prevent fluid flow therethrough from the second end of the tilt cylinder, and means operative in response to fluid flow through the second valve for temporarily opening the first valve to afford fluid flow from the first end of the tilt cylinder to the second end of the tilt cylinder.

Still more particularly, in accordance with an embodiment of the invention, the means for temporarily opening the first valve comprises a let-down valve housing having a first end communicating with the second valve and a second end communicating with the first valve, a piston reciprocable in the let-down valve housing between a first position adjacent to the first end of the let-down valve housing and a second position spaced from the first position in the direction away from the first end of the let-down housing, means on the piston operable when the piston is in the second position to open the first valve against the bias thereof, and bypass means affording restricted fluid flow from one side of the piston to the other, whereby application of pressure fluid to the first end of the let-down valve housing from the second valve displaces the piston from the first position to the second position to open the first valve so as to permit fluid flow from the first end of the tilt cylinder, through the first valve, through a part of the let-down valve housing, and to the second end of the tilt cylinder and whereby the piston will return from the second position to the first position in response to fluid flow through the restricted bypass means from the first end to the second end of the let-down valve housing.

One of the principal features of the invention is the provision of an improved selectively operable hydraulic system for power raising and lowering a propulsion assembly of a marine propulsion device.

One of the prinicpal features of the invention is the provision of a marine propulsion device which includes a hydraulic system for raising and lowering a propulsion assembly, which hydraulic system includes provision for affording automatic let-down of the propulsion assembly after the striking of an underwater obstacle.

Another of the principal features of the invention is the provision of a power operated hydraulic system for trimming and tilting the propulsion assembly of a marine propulsion device, which system includes means for affording let-down of the propulsion assembly after the striking of an underwater obstacle to a previously set trim position.

Other features and advantages of the embodiments of the invention will become apparent from the following general description, claims and appended drawings.

THE DRAWINGS

Figure 1:
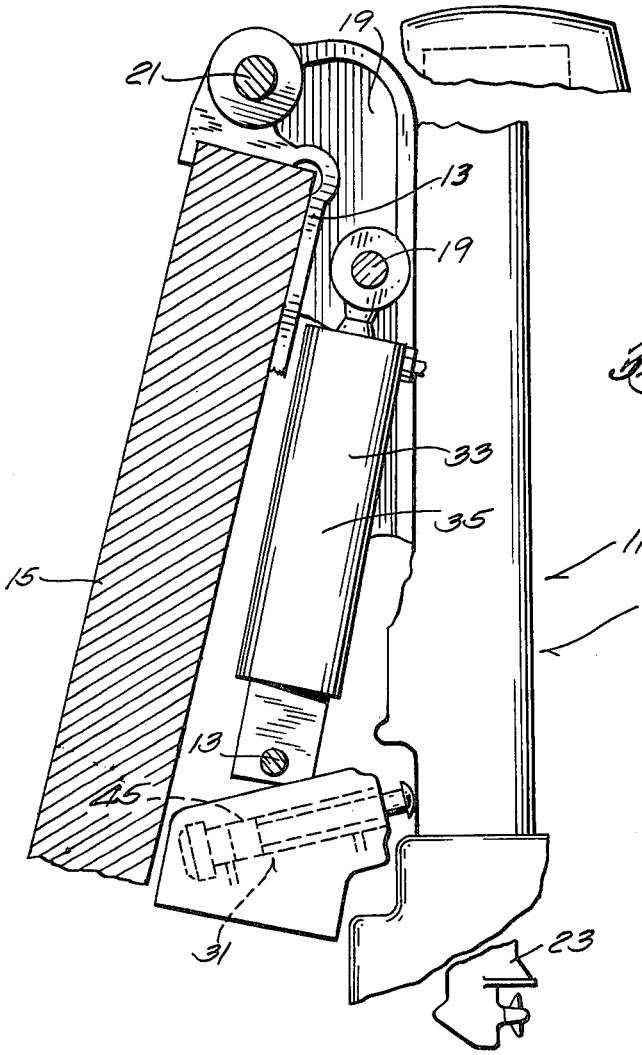
FIG. 1 is a partially schematic side-elevation view, partially in section, of a marine propulsion device incorporating various of the features of the invention.

Before explaining the embodiments of the invention in detail, it is to be understood that the invention is not limited in its application to the details of construction and the arrangement of the components set forth in the following description or illustrated in the drawings. The invention is capable of other embodiments and of being practiced and carried out in various ways. Also it is to be understood that the phraseology and terminology employed herein is for purpose of description and should not be regarded as limiting.

GENERAL DESCRIPTION

Shown in the drawings is a marine propulsion device which is shown schematically in the form of an outboard motor 11 including a member 13 adapted to be suitably attached to a boat hull 15, and a propulsion assembly 17 connected to the member 13 for vertical swinging movement between a fully lowered position and a fully raised position when the member 13 is connected to the boat hull 15. Any suitable form of propulsion assembly can be employed, including, for instance, a swivel bracket 19 connected to the member 13 about a horizontal tilt pin 21 and a propulsion unit 23 connected to the swivel bracket 13 for steering movement relative thereto. The invention is equally applicable to stern drive units and to outboard motors.

Figure 2:
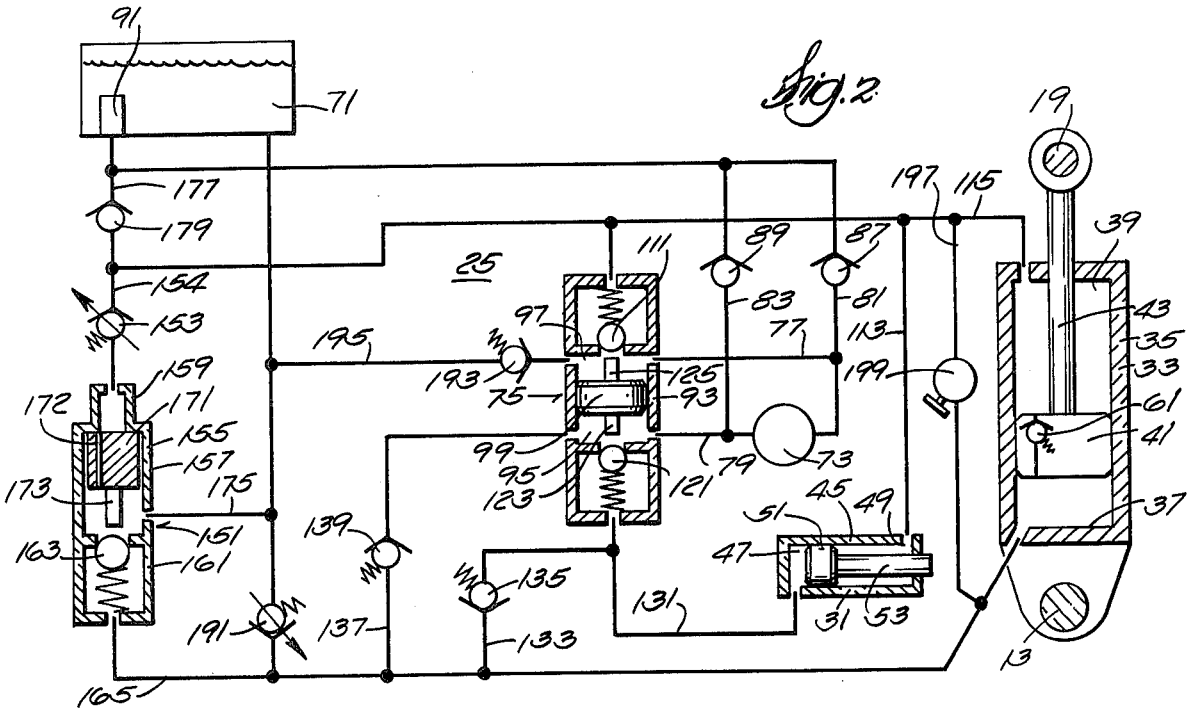
FIG. 2 is a schematic diagram of the hydraulic system incorporated in the marine propulsion device shown in FIG. 1.

Connected between the member 13 and the propulsion assembly 17 is (See FIG. 2) a hydraulic system 25 for tilting and trimming the propulsion assembly 17 relative to the boat mounted member 13. As used herein, "trimming" refers to angular adjustment or movement within a trim range extending up and from the fully lowered position of the propulsion assembly 17 and "tilting" refers to angular adjustment or movement within a tilt range extending upwardly from the top of the trim range to the fully elevated or raised position of the propulsion assembly 17.

The hydraulic system 25 includes one or more trim and tilt hydraulic cylinder-piston assemblies 31 and 33, respectively, which are connected between the member and the propulsion assembly. More particularly, the tilt cylinder-piston assembly 33 comprises a tilt cylinder 35 which has opposed first and second ends 37 and 39, respectively, which, at its first end 37, is pivotally connected to one of the member 13 and the propulsion assembly 17, and which contains a tilt piston 41 connected to a piston rod 43 which extends through the second tilt cylinder end 39 and is pivotally connected to the other of the member 13 and the propulsion assembly 17. Preferably, the tilt cylinder-piston assembly is connected between the member 13 and the swivel bracket 19 and the first end 37 of the tilt cylinder 35 is pivotally connected to the member 13 and the piston rod 43 is pivotally connected to the swivel bracket 19.

The trim cylinder-piston assembly 31 comprises a trim cylinder 45 which has opposed first and second ends 47 and 49, respectively, which is fixed to one of the member 13 and the propulsion assembly 17 and which includes a trim piston 51 connected to a piston rod 53 which extends through the second end 49 of the trim cylinder 45, and which is releasably engagable with the other of the member 13 and the propulsion assembly 17. Preferably, the trim cylinder 45 is fixed to the member 13 and the piston rod 53 is releasably engagable with the swivel bracket 19.

Located in the tilt piston 41 is a one way valve 61 which is in the form of a spring biased ball check valve and which prevents flow from the first end 37 of the tilt cylinder 35 to the second end 39, but which permits flow from the second end 39 of the tilt cylinder 35 to the first end 37 of the tilt cylinder 35 so that, in the event the propulsion assembly 17 impacts an underwater obstacle and the tilt cylinder 35 accordingly extends rapidly, the valve 61 will accommodate flow from the second end 39 of the tilt cylinder 35 through the tilt piston 41 to the first end 37 of the tilt cylinder 35. The bias on the valve 61 is relatively high, for instance, about 2500 lbs./sq.in.

Pressure fluid supply and control means are provided for selectively supplying the trim and tilt cylinder-piston assemblies 31 and 33 with pressure fluid. While various means can be employed, in the illustrated construction, such means comprises a reservoir or sump 71, a pump 73 operably connected to the sump 71, a control cylinder or valve 75 connected to the pump 73, and valved fluid conduits communicating between the control valve 75 and the tilt and trim cylinders 35 and 45.

More specifically, the pump 73 is in the form of a reversible pump which includes two fluid connections or ducts 77 and 79 with the duct 77 supplying pressure fluid when the pump 73 is rotating in one direction and with the other duct 79 supplying pressure fluid when the pump 73 is running in the opposite direction. The ducts 77 and 79 are respectively connected through conduits 81 and 83 with the reservoir 71. In turn, the conduits 81 and 83 include respective one-way valves 87 and 89 permitting flow to the pump 73 and preventing flow to the reservoir 71. Preferably, the conduits 81 and 83 communicate with the sump or reservoir 71 through a common filter 91.

The control valve 75 comprises a housing 93 which has opposing first and second ends 95 and 97 which respectively communicates with the ducts 79 and 77. The housing 93 includes therein a control piston 99 movable from a centered position to each of first and second end positions respectively adjacent to the first and second ends 95 and 97 of the housing 93 so that the first end 95 of the housing 93 is pressurized when the pump 73 is rotating in one direction and so that the second end 97 of the housing 93 is pressurized when the pump 73 is rotating in the other direction.

Communicating with the second end 97 of the control valve housing 93 is a spring biased, normally closed valve 111 which also communicates through respective conduits 113 and 115 with the second end 49 of the trim cylinder 45 and with the second end 39 of the tilt cylinder 35. Communicating with the first end 95 of the control valve housing 93 is another spring biased, normally closed valve 121.

Means are provided on the control piston 99 in the form of oppositely extending projections 123 and 125 for respectively opening the valves 121 and 111 when the control piston 99 is located in the first and second end positions. More specifically, when the first end 95 of the control valve housing 93 is pressurized, the projection 125 opens the valve 111 to permit fluid flow into the housing 93 and when the second end 97 of the control valve housing 93 is pressurized, the projection 123 opens the valve 121 to permit inflow of fluid from the respective first ends of the tilt cylinder 35 and trim cylinder 45.

When the pump 73 is not operating, the control piston 99 is located in its centered position and both valves 111 and 121 are closed by their respective springs.

The valve 121 communicates directly with the first end 47 of the trim cylinder 45 through a conduit 131.

The valve 121 also communicates with the first end 37 of the tilt cylinder 35 through a conduit 133 including a normally closed valve 135 which is in the form of a spring biased one-way valve, which prevents flow from the valve 121 to the first end 37 of the tilt cylinder 35, but which releasably prevents or permits flow from the first end 37 of the tilt cylinder 35 to the valve 121.

Also communicating with the first end 37 of the tilt cylinder 35 is another conduit 137 which extends from adjacent to the first end 95 of the control valve housing 93 and which includes a normally closed valve 139 which is in the form of a spring biased one-way valve, which prevents flow from the first end 37 of the tilt cylinder 33 to the control valve housing 93, but which releasably prevents or permits flow from the first end 95 of the control valve housing 93 to the first end 37 of the tilt cylinder 33 independently of the check valve 135.

The hydraulic system 25 also includes let-down means providing automatic transfer of pressure fluid from the first end 37 of the tilt cylinder 35 to the second end 39 of the tilt cylinder 35 in order to accommodate let-down of the propulsion assembly 17 after the striking of an underwater obstacle. More particularly, there is hydraulically connected between the ends 37 and 39 of the tilt cylinder 35 an automatic let-down assembly 151 which includes an actuating valve 153 which is in the form of a normally closed, spring biased check valve, and which communicates through a conduit 154 with the second end 39 of the tilt cylinder 35 and which is arranged to prevent flow to the second end 39 of the tilt cylinder 35 and to releasably prevent or permit flow from the second end 39 of the tilt cylinder 35 therethrough. The bias on the valve 153 is relatively high, for instance, about 2500 lbs./sq.in.

Also included in the let-down valve assembly 151 is a let-down valve 155 including a housing 157 having a first end 159 communicating with the valve 153 and a second end 161 communicating with a by-pass valve 163 which is in the form of a normally closed, spring biased check valve and which, in turn, communicates through a conduit 165 with the first end 37 of the tilt cylinder 35. The bias on the valve 163 is relatively low, for instance, about 25 lbs./sq.in.

Located within the let-down valve housing 157 is a let-down piston 171 which is movable between a first position adjacent to the first end 159 of the let-down valve housing 157 and a second position spaced from the first position in the direction toward the second end 161 of the let-down valve housing 157. The let-down piston 171 includes a restricted orifice or slot 172 which communicates between the first and second ends of the let-down valve housing 157. In addition, the let down piston 171 also includes a projection 173 which is operable, upon movement of the piston 171 to the second position, to open the valve 163 so as to permit fluid flow from the first end 37 of the tilt cylinder 35 into the let-down valve housing 157.

Communicating between the second end of the let-down valve housing 157 and the second end 39 of the tilt cylinder 35 is conduit means including a conduit 175 extending from adjacent the second end 161 of the let-down valve housing 157 to the sump 71, and a conduit 177 extending from the sump 71 to the second end 39 of the tilt cylinder 35 and including a one-way valve 179 preventing flow to the sump 71 and permitting flow from the sump 71.

The hydraulic system 25 also includes a normally closed overload valve 191 which communicates between the conduits 165 and 175 and which is in the form of a spring biased check valve arranged so as to permit flow from the conduit 165 to the conduit 175 and to prevent flow from the conduit 175 to the conduit 165 and hence from the first end 37 of the tilt cylinder 35 to the sump 71 in the event excess thrust is developed during operation of the propulsion assembly 17. In addition, when the control piston 99 is in the position providing power operated upward movement of the propulsion assembly 17, the overload valve 191 prevents overloading of the pump 73 by permitting bypassing of the pressure fluid to the sump 71 whenever movement of the trim piston 51 or tilt piston 41 is blocked, or when the propulsion assembly 17 is in the fully raised position. It is noted that the spring bias on the valve 191 is greater than the spring bias on the valve 139 and greater than the spring bias on the valve 135.

When the control piston 99 is in the position providing power operated downward movement, the valve 135 permits return flow from the first end 37 of the tilt cylinder 35 to the valve 121 and then through the control valve housing 93 and back through the duct 79 to the pump 73.

The hydraulic system 25 also includes a pressure relief valve 193 which communicates with the sump 71 through a conduit 195, which communicates with the second end 97 of the control valve housing 93, and which is operative to permit flow from the second end 97 of the control valve housing 93 to the sump 71 in the event of excess pressure when the control piston 99 is in the position providing power operated lowering of the propulsion assembly. In addition, the relief valve 193 also operates, when the control piston 99 is in the position affording power operated raising of the propulsion assembly 17, to prevent the relatively high pressures resulting from impact or shock absorbtion from adversely affecting the pump 73. The pressure relief valve 193 is preferably in the form of a normally closed, spring biased check valve and has a spring bias which is greater than the valve 111.

The hydraulic system 25 also includes a conduit 197 which connects the opposed ends 37 and 39 of the tilt cylinder 35 and which includes a manually operable valve 199 permitting bypass of fluid around the tilt piston 41 to accomodate manual raising and lowering of the propulsion assembly 17.

In operation and when it is desired to raise the propulsion assembly 17 by power operation, the pump 73 is operated in the proper direction to pressurize the first end 95 of the control valve housing 93 so as to displace the control piston 99 toward the end 97 of the control valve housing 93, thereby opening the adjacent valve 111. At the same time, the pump pressure opens the other valve 121 against its spring to supply pressure fluid through the conduit 131 to the first end 47 of the trim cylinder 45. In addition, pressure fluid flows through the conduit 137 and through the valve 139 to the first end 37 of the tilt cylinder 35.

At the same time, pressure fluid adjacent to the second end 39 of the tilt cylinder 35 and pressure fluid adjacent to the second end 49 of the trim cylinder 45 flows through the conduits 113 and 115 past the open valve 111 through the second end 97 of the control valve housing 93 and through the duct 77 to the intake of the pump. Make-up fluid is drawn from the pump 71 through the conduit 81 and through the check valve 87.

In the event there is an obstruction to upward travel of the propulsion assembly 17 or at the end of such travel, the pressure fluid supplied by the pump 73 flows back to the sump 71 through the conduit 137 including the valve 139, through the conduit 165, and through the overload valve 191 which operates as a pressure relief valve, and through the conduit 175 to the sump 71.

During power operated lowering of the propulsion assembly 17, the pump 73 is operated in the opposite direction, and serves to deliver pressure fluid through the duct 77 to the second end 97 of the control valve housing 93, thereby opening the adjacent valve 111 and displacing the control piston 99 to the position adjacent the first end 95 of the control valve housing 93 so as to also open the valve 121. Pressure fluid flows through the valve 111 and through the conduit 113 to the second end 49 of the trim cylinder 45 so as to retract the piston rod 51 and through the conduit 115 to the second end 39 of the tilt cylinder 35 to contract the tilt cylinder-piston assembly 33. At the same time, fluid adjacent the first end 37 of the tilt cylinder 35 flows through the conduit 133, including the valve 135, and past the open valve 121 to the end 95 of the control valve housing 93, then through the duct 79 to the inlet of the pump 73. If there is an obstruction to movement of the propulsion assembly 17, or at the end of such movement when the propulsion assembly 17 is in the fully lowered position, pressure fluid produced by the pump 73 is returned to the sump 71 via the pressure relief valve 193 through the conduit 195. Fluid is supplied to the pump 73 from the sump 71 for priming purposes through the conduit 83 and check valve 89.

In the event the propulsion assembly 17 strikes an underwater obstacle, sudden upward movement of the propulsion assembly 17 will cause extension of the tilt cylinder 35 and consequent immediate relatively high pressurization of the fluid adjacent to the second end 39 of the tilt cylinder 35. Under such circumstances, the pressure fluid flows past the tilt piston 41 through the valve 61 from the second end 39 to the first end 37 of the tilt cylinder 35 so as to permit such extension. As the pump 73 is not running, the control valve piston 99 is centered and both valves 111 and 121 are closed. During the period when the second end 39 of the tilt cylinder 35 is highly pressurized, such pressurization will be imparted through the conduit 154 to open the valve 153 so as to permit passage of a relatively small amount of highly pressurized fluid therethrough to the first end 159 of the let-down valve housing 157, which fluid is effective to displace the let-down piston 171 from the first position to the second position. Upon full extension of the tilt cylinder 35, the pressure condition at the second end 39 thereof will be relieved and the valve 153 will again close preventing return of the pressure fluid at the first end 159 of the let-down valve housing 157 through the valve 153 to the second end 39 of the tilt cylinder 35, thereby temporarily retaining the let-down valve piston 171 in the second position so as thereby to retain the valve 163 open.

Upon reaching the fully raised position, the propulsion assembly 17 will tend to return downwardly either because of impacting at the fully raised position or simply because of the weight of the motor. Temporary maintenance of the open condition of the valve 163 by the let-down valve piston 171 permits contraction of the tilt cylinder 35 accompanying lowering of the propulsion assembly 17. In this regard, contraction of the tilt cylinder 35 causes outflow of fluid from the first end 37 thereof, which outflow travels through the conduit 165, through the valve 163 into the second end 161 of the let-down valve housing 157 and through the conduit 175 back to the sump 71. At the same time, the expanding space at the second end 39 of the tilt cylinder 35 draws fluid from the sump 71 through the filter 91, and through the conduit 177 including the one-way valve 179 to the second end 39 of the tilt cylinder 35 to maintain the second end 39 of the tilt cylinder 35 fully occupied with hydraulic fluid.

Referring to the pressurized fluid trapped at the first end 159 of the let-down valve housing 157, such fluid gradually flows through the restricted orifice or slot 172 to the second end 161 of the let-down valve housing 157 and then through the conduit 175 to the sump 71. Such travel of the trapped fluid past the let-down piston 171 causes return movement of the let-down piston 171 toward the first end 159 of the let-down valve housing 157 under the influence of the spring biasing the valve 163 to the closed position, thereby eventually again permitting closing the valve 163 after completion of fluid flow from the first end 37 of the tilt cylinder 35 to the sump 71. Thus, the hydraulic system 25 is again conditioned for power operation, up or down, or for another impact.

It is particularly noted that the trim piston 51 does not move during impact tilting or let-down return, and thus the propulsion assembly 17 will always return after an impact to the previously set trim position. It is also noted that the pump 73 is isolated from the relatively high pressures generated in the second end 39 of the tilt cylinder 35 by sudden impact of the propulsion assembly 17 with an underwater obstacle by reason of the centered position of the control valve piston 99 and the closed condition of the valves 111 and 121.

Various of the features of the invention are set forth in the following claims.

I claim:

1. A marine propulsion device including a member adapted to be attached to a boat hull, a propulsion assembly connected to said member for vertical swinging movement relative thereto, a hydraulic cylinder-piston assembly connected to said member and to said propulsion assembly and including a tilt cylinder having opposed first and second ends, a piston reciprocable in said tilt cylinder, and a piston rod connected to said piston and extending from said second end of said tilt cylinder, and means communicating between said first and second ends of said tilt cylinder and including means operative for temporarily affording fluid flow from said first end of said tilt cylinder to said second end of said tilt cylinder in response to the generation of relatively high pressure adjacent said second end of said tilt cylinder occuring incident to the striking of an underwater obstacle.

2. A marine propulsion device in accordance with claim 1 wherein said means for temporarily affording fluid flow from said first end of said tilt cylinder to said second end of said tilt cylinder comprises a first valve communicating between said first end of said tilt cylinder and said second end of said tilt cylinder, said first valve being biased to releasably prevent fluid flow therethrough from said first end of said tilt cylinder, a second valve communicating with said second end of said tilt cylinder and biased to releasably prevent fluid flow therethrough from said second end of said tilt cylinder, and means operative in response to fluid flow through said second valve for temporarily opening said first valve to afford fluid flow from said first end of said tilt cylinder to said second end of said tilt cylinder.

3. A marine propulsion device in accordance with claim 2 wherein said means for temporarily opening said first valve comprises a let-down valve housing having a first end communicating with said second valve and a second end communicating with said first valve, a piston reciprocable in said let-down valve housing between a first position adjacent to said first end of said let-down valve housing and a second position spaced from said first position in the direction away from said first end of said let-down housing, means on said piston operable when said piston is in said second position to open said first valve against the bias thereof, and bypass means affording restricted fluid flow from one side of said piston to the other, whereby application of pressure fluid to said first end of said let-down valve housing from said second valve displaces said piston from said first position to said second position to open said first valve so as to permit fluid flow from said first end of said tilt cylinder, through said first valve, through a part of said let-down valve housing, and to said second end of said tilt cylinder and whereby said piston will return from said second position to said first position in response to fluid flow through said restricted bypass means from said first end to said second end of said let-down valve housing.

4. A marine propulsion device in accordance with claim 2 wherein said first valve communicates with said second end of said tilt cylinder through conduit means including valve means preventing flow from said second end of said tilt cylinder to said first valve.

5. A marine propulsion device in accordance with claim 4 wherein said conduit means includes a reservoir between said first valve and said valve means.

6. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, pressure fluid supply and control means including a control valve housing having first and second ends, first conduit means communicating between said first end of said tilt cylinder and said first end of said control valve housing and including a first valve preventing fluid flow from said first end of said control valve housing to said first end of said tilt cylinder and releasably preventing fluid flow from said first end of said tilt cylinder to said first end of said control valve housing, and second conduit means communicating between said first end of said tilt cylinder and said first end of said control valve housing and including a second valve preventing fluid flow from said first end of said tilt cylinder to said first end of said control valve housing and releasably preventing fluid flow from said first end of said control valve housing to said first end of said tilt cylinder, and a normally closed third valve located between said first end of said control valve housing and said first conduit means and arranged to releasably prevent fluid flow therethrough to and from said first end of said control valve housing.

7. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, a trim hydraulic cylinder-piston assembly including a trim cylinder fixed relative to one of said member and said propulsion assembly, having opposed first and second ends, and having therein a reciprocably movable trim piston having a piston rod extending through said second end of said trim cylinder and adapted for releasable engagement with the other of said member and said propulsion assembly, pressure fluid supply and control means, first conduit means communicating between said first end of said tilt cylinder and said pressure fluid supply and control means and including a first valve preventing fluid flow from said pressure fluid supply and control means to said first end of said tilt cylinder and releasably preventing fluid flow from said first end of said tilt cylinder to said pressure fluid supply and control means, second conduit means communicating between said first end of said tilt cylinder and said pressure fluid supply and control means and including a second valve preventing flow from said first end of said tilt cylinder to said pressure fluid supply and control means and releasably preventing fluid flow from said pressure fluid supply and control means to said first end of said tilt cylinder, and third conduit means communicating between said first end of said trim cylinder and said first conduit means intermediate said pressure fluid supply and control means and said first valve.

8. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, a trim hydraulic cylinder-piston assembly including a trim cylinder fixed relative to one of said member and said propulsion assembly, having opposed first and second ends, and having therein a reciprocably movable trim piston having a piston rod extending through said second end of said trim cylinder and adapted for releasable engagement with the other of said member and said propulsion assembly, pressure fluid supply and control means including a control valve housing having first and second ends, first conduit means communicating between said first end of said tilt cylinder and said first end of said control valve housing and including a first valve preventing fluid flow from said pressure fluid supply and control means to said first end of said tilt cylinder and releasably preventing fluid flow from said first end of said tilt cylinder to said first end of said control valve housing, second conduit means communicating between said first end of said tilt cylinder and said first end of said control valve housing and including a second valve preventing flow from said first end of said tilt cylinder to said first end of said control valve housing and releasably preventing fluid flow from said first end of said control valve housing to said first end of said tilt cylinder, third conduit means communicating between said first end of said trim cylinder and said first end of said control valve housing, a normally closed third valve located between said first end of said control valve housing and said first and third conduit means and arranged to releasably prevent fluid flow therethrough to and from said first end of said control valve housing, and a normally closed fourth valve communicating between said second end of said control valve housing and said second end of said tilt cylinder and said second end of said trim cylinder and arranged to releasably prevent flow therethrough to and from said second end of said control valve housing.

9. A marine propulsion device in accordance with claim 8 wherein said pressure fluid supply and control means further comprises means for supplying pressure fluid selectively to adjacent said first and second ends of said control valve housing, a piston located in said control valve housing and movable relative to a centered position located midway between said first and second ends of said control valve housing, a first end position located adjacent to said first end of said control valve housing and affording communication between said fluid supply means and said third valve, and a second end position located adjacent to said second end of said control valve housing and affording communication between said fluid supply means and said fourth valve, means on said piston opening said third valve when said piston is in said first end position, and means on said piston opening said fourth valve when said piston is in said second end position.

10. A marine propulsion device in accordance with claim 8 and further including a reservoir and wherein said fourth valve includes means biasing said fourth valve toward the normally closed condition, and further including a fifth valve which is normally closed and which communicates with said second end of said control valve housing and with said reservoir, said fifth valve including means biasing said fifth valve toward the normally closed condition, said biasing means of said fifth valve having greater resistance than said biasing means of said fourth valve.

11. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, pressure fluid supply and control means, first conduit means communicating between said first end of said tilt cylinder and said pressure fluid supply and control means and including a first valve preventing fluid flow from said pressure fluid supply and control means to said first end of said tilt cylinder and releasably preventing fluid flow from said first end of said tilt cylinder to said pressure fluid supply and control means, second conduit means communicating between said first end of said tilt cylinder and said pressure fluid supply and control means and including a second valve preventing flow from said first end of said tilt cylinder to said pressure fluid supply and control means and releasably preventing fluid flow from said pressure fluid supply and control means to said first end of said tilt cylinder, and a normally closed relief valve communicating between said second conduit means and a sump and arranged to afford fluid flow from said second conduit means in the event of a pressure therein above a predetermined level.

12. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, pressure fluid supply and control means, first conduit means communicating between said first end of said tilt cylinder and said pressure fluid supply and control means and including a first valve preventing fluid flow from said pressure fluid supply and control means to said first end of said tilt cylinder and releasably preventing fluid flow from said first end of said tilt cylinder to said pressure fluid supply and control means, second conduit means communicating between said first end of said tilt cylinder and said pressure fluid supply and control means and including a second valve preventing flow from said first end of said tilt cylinder to said pressure fluid supply and control means and releasably preventing fluid flow from said pressure fluid supply and control means to said first end of said tilt cylinder, and additional conduit means communicating between said first and second ends of said tilt cylinder and including means operative for temporarily affording fluid flow from said first end of said tilt cylinder to said second end of said tilt cylinder to permit downswing of said propulsion assembly in response to the previous generation of relatively high pressure adjacent said second end of said tilt cylinder occurring incident to the striking of an underwater obstacle.

13. A marine propulsion device in accordance with claim 12 wherein said means for temporarily affording fluid flow from said first end of said tilt cylinder to said second end of said tilt cylinder comprises a by-pass valve communicating between said first end of said tilt cylinder and said second end of said tilt cylinder, said by-pass valve being biased to releasably prevent fluid flow therethrough from said first end of said tilt cylinder, an actuating valve communicating with said second end of said tilt cylinder and biased to releasably prevent fluid flow therethrough from said second end of said tilt cylinder, and means operative in response to fluid flow through said actuating valve for temporarily opening said by-pass valve to afford fluid flow from said first end of said tilt cylinder to said second end of said tilt cylinder.

14. A marine propulsion device in accordance with claim 13 wherein said means for temporarily opening said by-pass valve comprises a let-down valve housing having a first end communicating with said actuating valve and a second end communicating with said by-pass valve, a piston reciprocable in said let-down valve housing between a first position adjacent to said first end of said let-down valve housing and a second position spaced from said first position in the direction away from said first end of said let-down valve housing, means on said piston operable when said piston is in said second position to open said by-pass valve against the bias thereof, and by-pass means affording restricted fluid flow from one side of said piston to the other, whereby application of pressure fluid to said first end of said let-down valve housing from said actuating valve displaces said piston from said first position to said second position to open said by-pass valve so as to permit fluid flow from said first end of said tilt cylinder, through said by-pass valve, through a part of said let-down valve housing, and to said second end of said tilt cylinder and whereby said piston will return from said second position to said first position in response to fluid flow through said restricted bypass means from said first end to said second end of said let-down valve housing.

15. A marine propulsion device in accordance with claim 13 wherein said by-pass valve communicates with said second end of said tilt cylinder through conduit means including valve means preventing flow from said second end of said tilt cylinder to said by-pass valve.

16. A marine propulsion device in accordance with claim 15 wherein said conduit means includes a reservoir between said by-pass valve and said valve means.

17. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed ends, a control valve adapted to communicate with a source of pressure fluid, first conduit means communicating between one of said ends of said tilt cylinder and said control valve and including a first valve preventing fluid flow from said control valve to said one end of said tilt cylinder and releasably preventing fluid flow from said one end of said tilt cylinder to said control valve, and second conduit means communicating between said one end of said tilt cylinder and said control valve and including a second valve preventing fluid flow from said one end of said tilt cylinder to said control valve and releasably preventing fluid flow from said control valve to said one end of said tilt cylinder, and a normally closed third valve located between said control valve and said first conduit means and arranged to releasably prevent fluid flow through said first conduit means to said control valve independently of said second valve.

18. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed ends, a trim hydraulic cylinder-piston assembly including a trim cylinder fixed relative to one of said member and said propulsion assembly, having opposed first and second ends, and having therein a reciprocably movable trim piston having a piston rod extending through said second end of said trim cylinder and adapted for releasable engagement with the other of said member and said propulsion assembly, a control valve adapted to communicate with a source of pressure fluid, first conduit means communicating between one of said ends of said tilt cylinder and said control valve and including a first valve preventing fluid flow from said control valve to said one end of said tilt cylinder and releasably preventing fluid flow from said one end of said tilt cylinder to said control valve, second conduit means communicating between said one end of said tilt cylinder and said control valve and including a second valve preventing flow from said one end of said tilt cylinder to said control valve and releasably preventing fluid flow from said control valve to said one end of said tilt cylinder, and third conduit means communicating between said first end of said trim cylinder and said control valve.

19. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed ends, a trim hydraulic cylinder-piston assembly including a trim cylinder fixed relative to one of said member and said propulsion assembly, having opposed first and second ends, and having therein a reciprocably movable trim piston having a piston rod extending through said second end of said trim cylinder and adapted for releasable engagement with the other of said member and said propulsion assembly, a control valve housing adapted to communicate with a source of pressure fluid and having first and second ends, first conduit means communicating between one of said ends of said tilt cylinder and said first end of said control valve housing and including a first valve preventing fluid flow from said control valve housing to said one end of said tilt cylinder and releasably preventing fluid flow from said one end of said tilt cylinder to said control valve housing, second conduit means communicating between said one end of said tilt cylinder and said first end of said control valve housing and including a second valve preventing flow from said one end of said tilt cylinder to said control valve housing and releasably preventing fluid flow from said control valve housing to said one end of said tilt cylinder, third conduit means communicating between said one end of said trim cylinder and said first end of said control valve housing, a normally closed third valve connected between said first end of said control valve housing and said first and third conduit means and arranged to releasably prevent fluid flow therethrough to and from said control valve housing, and a normally closed fourth valve connected between said second end of said control valve housing and the other of said ends of said tilt cylinder and said second end of said trim cylinder and arranged to releasably prevent flow therethrough to and from said control valve housing.

20. A marine propulsion device in accordance with claim 19 further comprising means for supplying pressure fluid selectively to adjacent said first and second ends of said control valve housing, a piston located in said control valve housing and movable relative to a centered position located midway between said first and second ends of said control valve housing, a first end position located adjacent to said first end of said control valve housing, and a second end position located adjacent to said second end of said control valve housing, means on said piston opening said third valve when said piston is in said first end position, and means in said piston opening said fourth valve when said piston is in said second end position.

21. A marine propulsion device in accordance with claim 20 and further including a reservoir and wherein said fourth valve includes means biasing said fourth valve toward the normally closed condition, and further including a fifth valve which is normally closed and which communicates with said second end of said control valve housing and with said reservoir, said fifth valve including means biasing said fifth valve toward the normally closed condition, said biasing means of said fifth valve having greater resistance than said biasing means of said fourth valve.

22. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed ends, a control valve adapted to communicate with a source of pressure fluid, first conduit means communicating between one of said ends of said tilt cylinder and said control valve and including a first valve preventing fluid flow from said control valve to said one end of said tilt cylinder and releasably preventing fluid flow from said one end of said tilt cylinder to said control valve, second conduit means communicating between said one end of said tilt cylinder and said control valve and including a second valve preventing flow from said one end of said tilt cylinder to said control valve and releasably preventing fluid flow from said control valve to said one end of said tilt cylinder, and a normally closed relief valve communicating between said second conduit means and a sump and arranged to afford fluid flow from said second conduit means in the event of a pressure therein above a predetermined level.

23. A marine propulsion device including a member adapted to be attached to a boat hull, a propulsion assembly pivotally connected to said member for vertical swinging movement when said member is attached to the boat hull, a tilt hydraulic cylinder-piston assembly connected between said member and said propulsion assembly and including a tilt cylinder having opposed first and second ends, a control valve adapted to communicate with a source of pressure fluid, first conduit means communicating between said first end of said tilt cylinder and said control valve and including a first valve preventing fluid flow from said control valve to said first end of said tilt cylinder and releasably preventing fluid flow from said first end of said tilt cylinder to said control valve, second conduit means communicating between said first end of said tilt cylinder and said control valve and including a second valve preventing flow from said first end of said tilt cylinder to said control valve and releasably preventing fluid flow from said control valve to said first end of said tilt cylinder, and additional conduit means exterior of said tilt cylinder and communicating between said first and second ends of said tilt cylinder and including means operative for temporarily affording fluid flow from said first end of said tilt cylinder to said second end of said tilt cylinder to permit downswing of said propulsion assembly in response to the previous generation of relatively high pressure adjacent said second end of said tilt cylinder occurring incident to the striking of an underwater obstacle.

24. A marine propulsion device in accordance with claim 23 wherein said means for temporarily affording fluid flow from said first end of said tilt cylinder to said second end of said tilt cylinder comprises a by-pass valve communicating between said first end of said tilt cylinder and said second end of said tilt cylinder, said by-pass valve being biased to releasably prevent fluid flow therethrough from said first end of said tilt cylinder, an actuating valve communicating with said second end of said tilt cylinder and biased to releasably prevent fluid flow therethrough from said second end of said tilt cylinder, and means operative in response to fluid flow through said actuating valve for temporarily opening said by-pass valve to afford fluid flow from said first end of said tilt cylinder to said second end of said tilt cylinder.

25. A marine propulsion device in accordance with claim 24 wherein said means for temporarily opening said by-pass valve comprises a let-down valve housing having a first end communicating with said actuating valve and a second end communicating with said by-pass valve, a piston reciprocable in said let-down valve housing between a first position adjacent to said first end of said let-down valve housing and a second position spaced from said first position in the direction away from said first end of said let-down valve housing, means on said piston operable when said piston is in said second position to open said by-pass valve against the bias thereof, and bypass means affording restricted fluid flow from one side of said piston to the other, whereby application of pressure fluid to said first end of said let-down valve housing from said actuating valve displaces said piston from said first position to said second position to open said by-pass valve so as to permit fluid flow from said first end of said tilt cylinder, through said by-pass valve, through a part of said let-down valve housing, and to said second end of said tilt cylinder and whereby said piston will return from said second position to said first position in response to fluid flow through said restricted bypass means from said first end to said second end of said let-down valve housing.

26. A marine propulsion device in accordance with claim 24 wherein said by-pass valve communicates with said second end of said tilt cylinder through conduit means including valve means preventing flow from said second end of said tilt cylinder to said by-pass valve.

27. A marine propulsion device in accordance with claim 26 wherein said conduit means includes a reservoir between said by-pass valve and said valve means.

* * * * *

UNITED STATES PATENT AND TRADEMARK OFFICE

CERTIFICATE OF CORRECTION

PATENT NO. : 4,096,820

DATED : June 27, 1978

INVENTOR(S) : Charles B. Hall

It is certified that error appears in the above-identified patent and that said Letters Patent are hereby corrected as shown below:

Column 7, line 42 "pump" (second occurrence) should read -- sump --.

Signed and Sealed this

*Eighth* Day of *July 1980*

[SEAL]

*Attest:*

SIDNEY A. DIAMOND

*Attesting Officer*

*Commissioner of Patents and Trademarks*